US010329730B2

(12) United States Patent
Whitmer et al.

(10) Patent No.: US 10,329,730 B2
(45) Date of Patent: Jun. 25, 2019

(54) POST DRIVER GUIDE COLLET AND METHOD OF USING THE SAME

(71) Applicant: Rhino Tool Company, Kewanee, IL (US)

(72) Inventors: Herbert W. Whitmer, Kewanee, IL (US); Robert J. Conner, Kewanee, IL (US); James V. Martin, Kewanee, IL (US)

(73) Assignee: RHINO TOOL COMPANY, Kewanee, IL (US)

( * ) Notice: Subject to any disclaimer, the term of this patent is extended or adjusted under 35 U.S.C. 154(b) by 946 days.

(21) Appl. No.: 14/174,432

(22) Filed: Feb. 6, 2014

(65) Prior Publication Data

US 2015/0217419 A1 Aug. 6, 2015

(51) Int. Cl.
*E02D 7/14* (2006.01)
*E04H 17/26* (2006.01)

(52) U.S. Cl.
CPC ..... *E02D 7/14* (2013.01); *E04H 17/263* (2013.01); *Y10T 29/49817* (2015.01); *Y10T 279/17564* (2015.01)

(58) Field of Classification Search
CPC ... E02D 7/14; B25F 5/02; B25F 5/029; E04H 17/26; E04H 17/261
USPC ..... 173/128, 90, 114, 132, 170
See application file for complete search history.

(56) References Cited

U.S. PATENT DOCUMENTS 1,411,292 A * 4/1922 Mueller ..... F16D 1/04 242/571.4
2,108,032 A * 2/1938 Allen ..... B25D 17/08 279/19
2,525,316 A * 10/1950 Schiff ..... B25D 1/12 144/195.5
2,693,086 A 11/1954 Caruthers et al.
3,152,429 A * 10/1964 Stanley ..... B65B 31/003 53/510
3,616,866 A * 11/1971 Verheul ..... E02D 5/523 173/131
4,367,800 A * 1/1983 Arentsen ..... E02D 7/10 173/127
4,476,749 A * 10/1984 McKean ..... B25B 21/002 81/53.2
4,955,622 A 9/1990 Peterson
(Continued)

FOREIGN PATENT DOCUMENTS

AU 2010100106 * 3/2010 ..... E04H 17/26
DE 3443186 A1 5/1986
DE 19603235 A1 7/1997

*Primary Examiner* — Gloria R Weeks
*Assistant Examiner* — Dariush Seif
(74) *Attorney, Agent, or Firm* — Thompson Coburn LLP

(57) ABSTRACT

A guide collet for a post driver having a main body configured to partially receive a post therein is attachable to the main body of the post driver and comprises a plurality of parts that collectively form a collet opening when the parts are attached to the main body of the post driver. The collet opening is configured and adapted to slideably receive a post. The parts of the guide collet are separable from each other without tools when the guide collet is detached from the main body of the post driver such that the guide collet is capable of being separated from a post that previously extended through the collet opening without sliding an end of the post through the collet opening.

4 Claims, 7 Drawing Sheets

(56) References Cited

U.S. PATENT DOCUMENTS

| | | | | | |
|---|---|---|---|---|---|
| 5,050,896 | A | | 9/1991 | Peterson | |
| 5,113,950 | A | * | 5/1992 | Krasnoff | B25D 9/14 173/13 |
| 5,133,566 | A | | 7/1992 | Baker | |
| 5,145,194 | A | | 9/1992 | Huff et al. | |
| 5,615,590 | A | * | 4/1997 | Speckhahn | B23B 13/126 279/143 |
| 5,918,886 | A | * | 7/1999 | Horiuchi | B23B 31/008 279/58 |
| D437,865 | S | * | 2/2001 | Kladich | D15/140 |
| D451,112 | S | * | 11/2001 | Trybula | D15/140 |
| D455,766 | S | * | 4/2002 | Lisowski | D15/140 |
| 6,626,247 | B1 | * | 9/2003 | Nordlin | E02D 13/00 173/114 |
| 7,152,694 | B2 | * | 12/2006 | Dennis | E04H 17/263 173/100 |
| D656,805 | S | * | 4/2012 | Baumann | D8/70 |
| D684,833 | S | * | 6/2013 | Baumann | D15/140 |
| D711,733 | S | * | 8/2014 | Whitmer | D8/397 |
| D733,191 | S | * | 6/2015 | Whitmer | D15/21 |
| 2005/0161889 | A1 | * | 7/2005 | Casel | B23B 31/202 279/43 |
| 2008/0179105 | A1 | * | 7/2008 | Duncan | B23B 51/0426 175/420.1 |
| 2009/0278323 | A1 | * | 11/2009 | Hangleiter | B23B 31/265 279/4.08 |
| 2010/0323318 | A1 | * | 12/2010 | Schmitt | A61C 1/0046 433/29 |
| 2012/0111593 | A1 | * | 5/2012 | O'Toole | E04H 17/263 173/90 |
| 2013/0192037 | A1 | * | 8/2013 | Muilenburg | B23P 6/00 29/402.09 |

* cited by examiner

POST DRIVER GUIDE COLLET AND METHOD OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

APPENDIX

Not applicable.

BACKGROUND OF THE INVENTION

1. Field of the Invention

The present invention pertains to post drivers. More particularly, the present invention pertains to a multipart guide collet that can easily be detached from a post in the event that the end of the post deforms.

2. General Background

Post drivers are used to drive posts axially into the earth or other materials. Such posts may be rods, bars, tubes, etc. For example, post drivers are often used to drive rebars into the ground. A typical post driver comprises a hammer that reciprocates and intermittently strikes an anvil. The anvil engages an axial end of the post being driven. The impact loads are thereby transferred from the anvil to the post so as to drive the post. In some cases the anvil is movable relative to the rest of the post driver such that the remainder of the post driver does not experience the impact loads. To eliminate torsion loads on the anvil, the post preferably should be axially aligned with the center of mass of the anvil. Of course, not all posts have the same diameter and it's therefore desirable to configure a post driver to handle posts of different diameter. Thus, a post driver is often provided with various bolt-on collets/adapters adapted for specific post diameters for radially guiding the post relative to the anvil. On occasion, the end of a post may become mushroomed, which often makes the post difficult to remove from such collets.

SUMMARY OF THE INVENTION

The present invention overcomes the disadvantages associated with prior art post drivers by providing a collet that can be removed from a post without axially sliding the post out of the collet.

In one aspect of the invention, a post driver comprises a main body, an anvil, a hammer, a motor, and a guide collet. The main body has an axial end and a cavity. The axial end has an axial opening configured and adapted to allow a post to be inserted partially in the cavity of the main body therethrough. The anvil is positioned within the cavity of the main body and is configured to be movable axially between first and second positions. The hammer is positioned within the cavity of the main body and is configured to be movable axially in a manner such that the hammer can impact the anvil when the anvil is in its first position. The motor is configured and adapted to axially reciprocate the hammer within the main body in a manner such that the hammer can intermittently impact the anvil when the anvil is in its first position. The guide collet comprises first and second separable parts and is removably attached to the axial end of the main body in a manner such that the guide collet is at least partially positioned within the cavity of the main body and in a manner such that the first and second separable parts are fixed in position relative to each other. The guide collet comprises a collet opening that is aligned with the axial opening of the main body. The collet opening is configured and adapted to allow a post to be inserted partially in the cavity of the main body therethrough in a manner such that the post can contact the anvil when the anvil is in its first position. The first and second parts of the guide collet are separable from each other when the guide collet is detached from the main body in a manner such that the guide collet can be separated from a post passing through the collet opening without axially withdrawing said post from the collet opening.

In another aspect of the invention, a guide collet for a post driver having a main body configured to partially receive a post therein is attachable to the main body of the post driver and comprises a plurality of parts that collectively form a collet opening when the parts are attached to the main body of the post driver. The collet opening is configured and adapted to slideably receive a post. The parts of the guide collet are separable from each other without tools when the guide collet is detached from the main body of the post driver such that guide collet is capable of being separated from a post that previously extended through the collet opening without sliding an end of the post through the collet opening.

In yet another aspect of the invention, a method comprises inserting a post partially into a post driver. The post driver comprises a main body having a cavity and guide collet attached to an end of the main body. The guide collet comprises a plurality of parts that collectively form a post opening. The insertion includes passing an end of the post through the post opening of the guide collet and into the cavity in a manner such that post extends through the collet opening. The method further comprises removing the post from the post driver by detaching the guide collet from the main body and separating the parts of the guide such that the removal of the post occurs without passing the end of the post through the opening of the guide collet.

Further features and advantages of the present invention, as well as the operation of the invention, are described in detail below with reference to the accompanying drawings.

Figure 1:
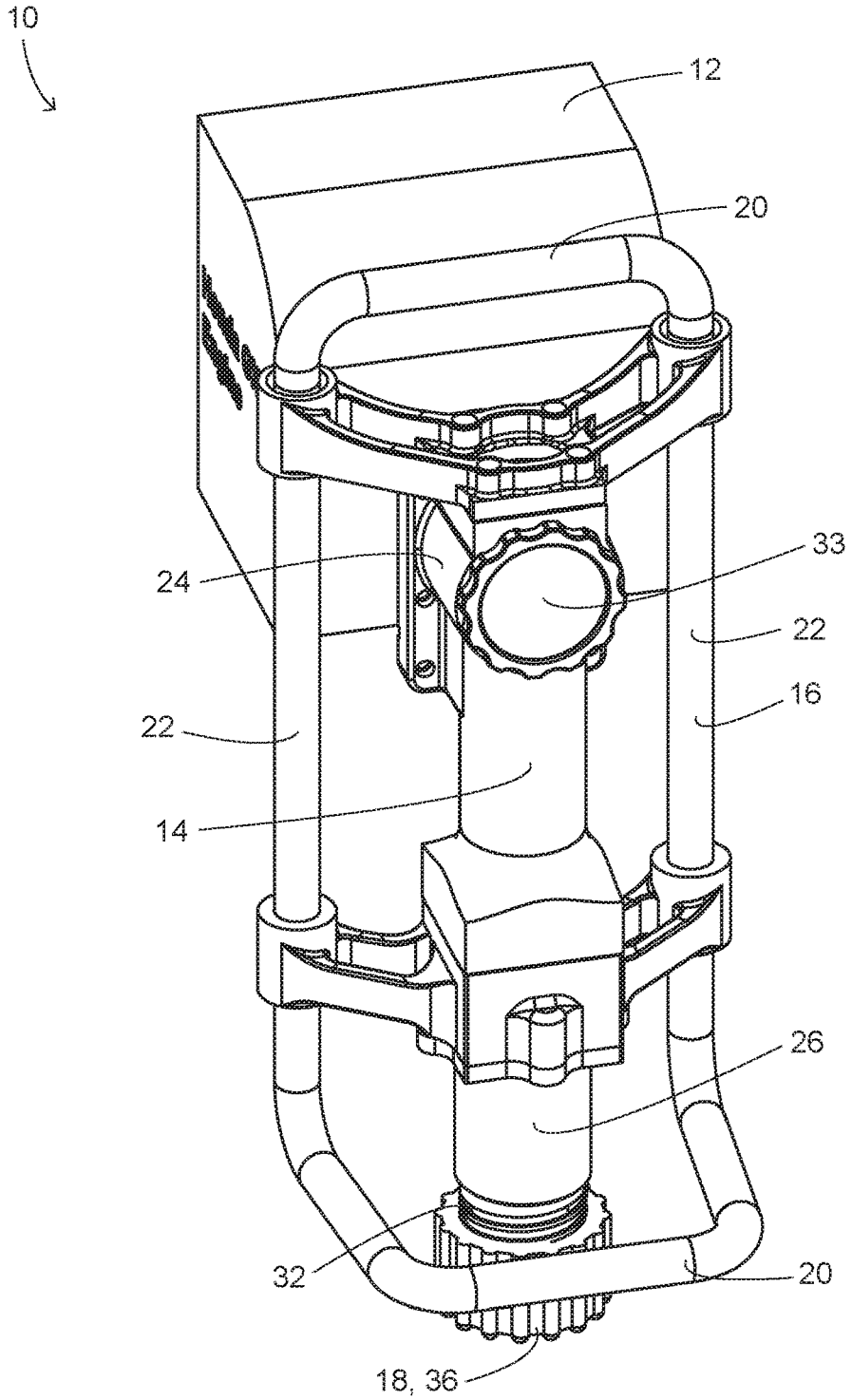
FIG. 1 depicts the preferred embodiment of a post driver in accordance with the invention.
Figure 2:
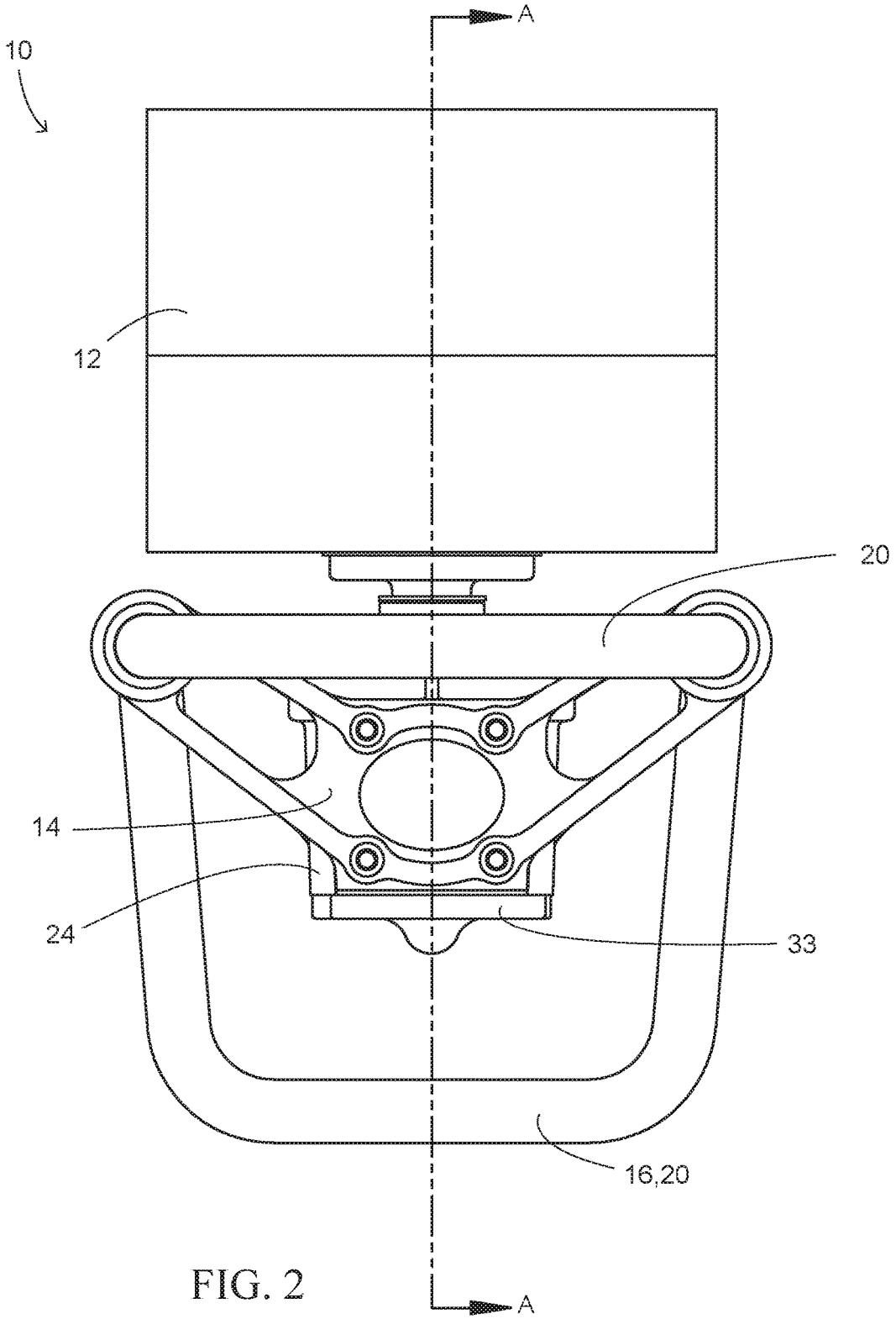
FIG. 2 depicts a top view of the post driver.

Reference numerals in the written specification and in the drawing figures indicate corresponding items.

DETAILED DESCRIPTION

A post driver in accordance with the invention is shown in FIG. 1. The post driver 10 comprises a motor 12, a main body 14, a handle 16, and a collet assembly 18. The motor 12 is represented in box-like form in the figures, but is preferably a gas powered four-stroke internal combustion engine such as a Honda® GX-35 engine. However, it should be appreciated that other motors could be used, including electric, pneumatic, or hydraulic motors. The handle 16 is preferably a single piece of tubing that preferably forms multiple grip portions. More preferably, the grip portions include a pair of horizontal grip portions 20 and a pair of vertical grip portions 22. The horizontal grip portions 20 are vertically spaced from each other and are preferably also offset horizontally from each other to make it easier to hold and maneuver the post driver 10 while bending over. The vertical grip portions 22 are preferably symmetrically spaced on opposite sides of the main body 14 of the post driver 10, preferably at or close to the vertical plane defined by the center of gravity of the post driver.

Figure 3:
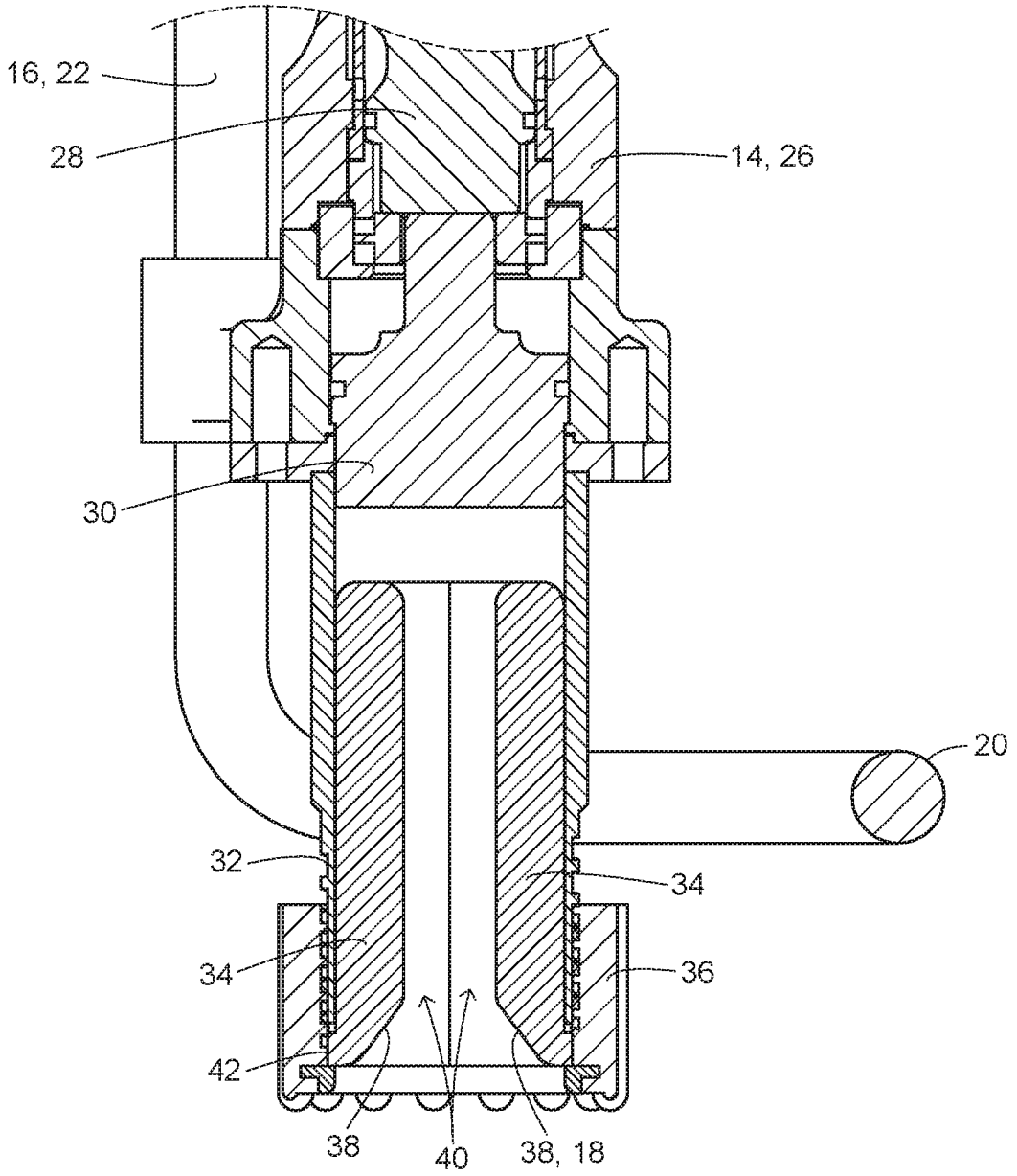
FIG. 3 depicts a cross-sectional view of the collet assembly and the lower portion of the main body of the post driver taken about the line A-A shown in FIG. 2, and shows the anvil in its lowermost position.

The main body 14 of the post driver 10 comprises a crankcase 24 and a multipart tube portion 26. Although not shown in the figures, the crankcase comprises a crank that converts rotational energy into linear reciprocation of a piston. The reciprocation of the piston compresses and decompresses air within the tube portion 26, which causes a hammer 28 to linearly reciprocate within the tube portion 26. The main body of the post driver 10 also comprises an anvil 30. The anvil 30 is preferably movable between two limits of vertical travel (one shown in FIG. 3 and the other shown in FIG. 4). In at least its uppermost position, the anvil 30 is configured to be impacted by the hammer 28. The bottom end of the tube portion 26 preferably comprises an attachment portion 32 for securing the collet assembly 18 thereto. The attachment portion 32 is preferably an external threaded portion, but alternatively could be any type of common attachment means such as, for example, a bayonet fitting. A cap 33 is provided on the front of the crankcase 24. Preferably the cap 33 is configured to be removed from the crankcase 24 by hand and without the use of tools, which allows quick inspection of the oil within the crankcase. Preferably the cap 33 is thread onto the crankcase 24.

Figure 7:
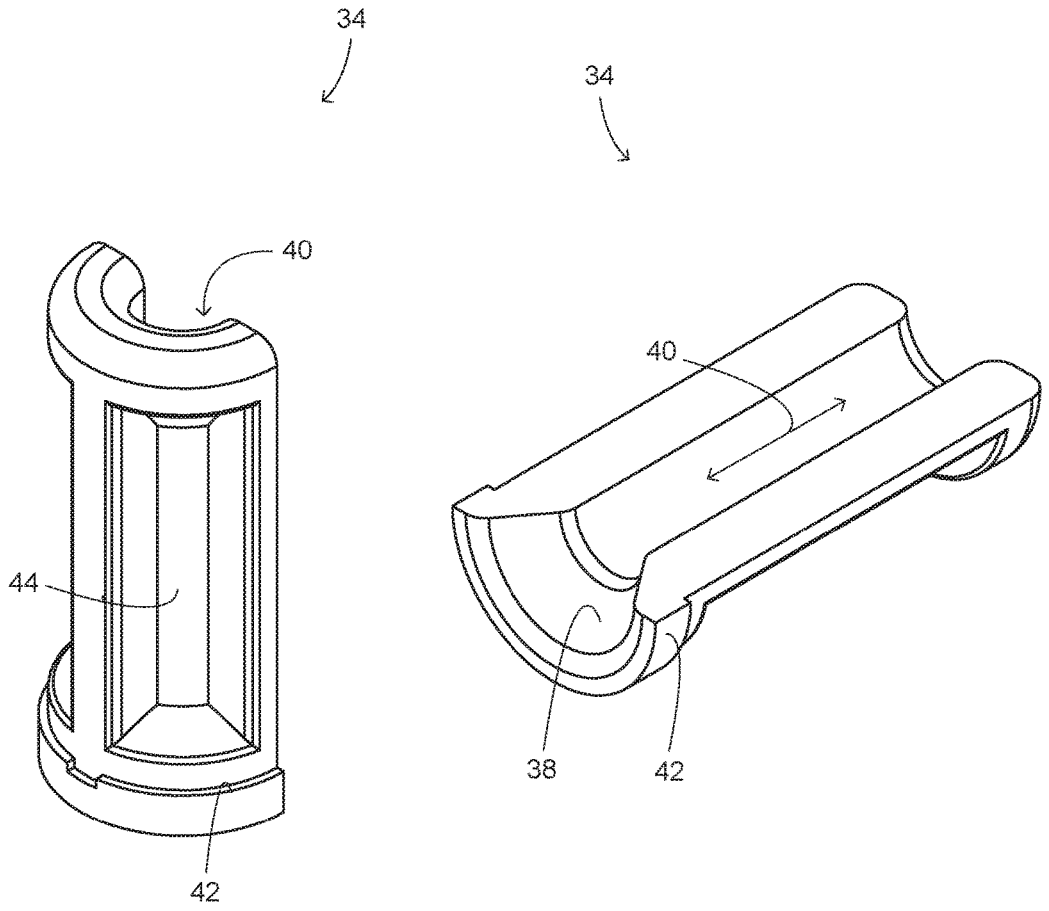
FIG. 7 is a perspective view of the guide collet members of the post driver.

The collet assembly 18 preferably comprises two guide collet members 34, which are preferably identical to each other, and a separate attachment member 36. A shown most clearly in FIG. 7, each guide collet member 34 preferably comprises a frustoconical lead-in recess 38 that leads to a semicylindrical channel 40. Additionally, each guide collet member 34 comprises a rim 42 and a plurality of recesses 44. When attached to the lower end of the tube portion 26 of the main body 14 of the post driver 10, the majority of each guide collet member 34 extends into the tube portion of the main body and their semicylindrical channels 40 collectively form a collet opening that, as explained in greater detail below, is adapted and configured to receive a particular post diameter. The rim 42 of each guide collet member 34 is configured to serve as a stop that prevents the collet member from sliding completely into the tube portion 26 of the main body 14 of the post driver 10. The recesses 44 of the guide collet members 34 merely reduce that material required to form the collet members. Preferably, that material is Delrin® or some other acetal, but other materials would be suitable too. The attachment member 36 is preferably a threaded nut having a graspable exterior that is configured to such that the attachment member can easily be operated by hand. The attachment member 36 threads onto the attachment portion 32 of the main body 14 of the post driver 10 and clamps the rims 42 of the guide collet members 34 to the lower end of the tube portion 26 of the main body 14, thereby removably securing the collet members 34 to the tube portion.

Figure 4:
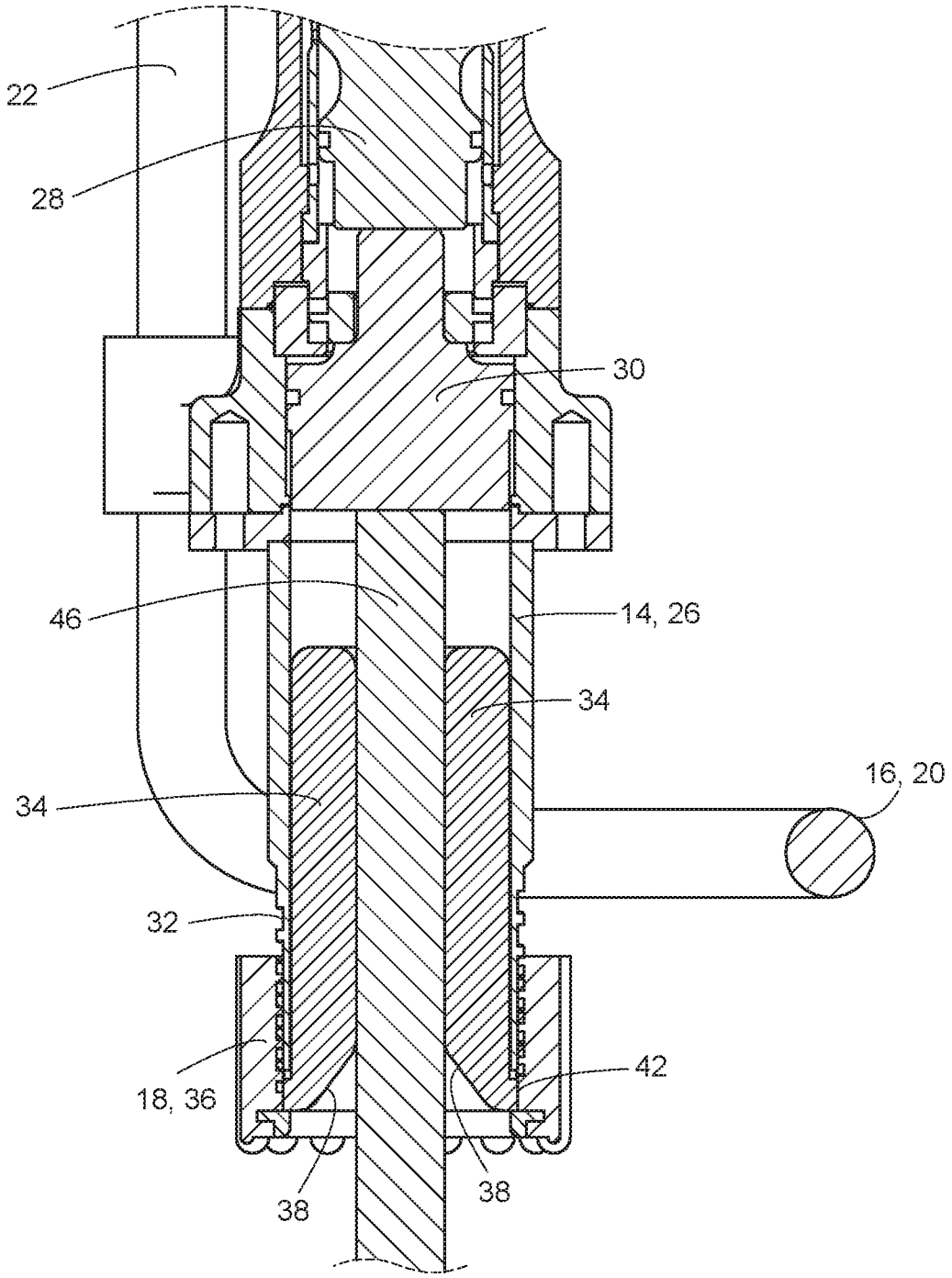
FIG. 4 is a similar cross-sectional view and shows a post passing through the collet assembly and anvil in its uppermost position.

In use, a post 46 can be driven by the post driver 10 by inserting an end of the post through the collet opening of the post driver. The posts 46 should have a diameter that is just slightly less than the diameter of the semicylindrical channels 40 of the guide collet members 34. Of course, various different sized collets are provided to accommodate various post diameters. As a post 46 is being inserted through the collet opening formed by the guide collet members 34, the frustoconical lead-in portions 38 of the collet members help align the post with the collet opening. As shown in FIG. 4, when inserted into tube portion 26 of the post driver 10, the end of the post 46 will extend through the collet opening and contact the anvil 30 in a manner causing the anvil 30 to move to its uppermost position. The post 46 can then be driven into the ground or other surface by operating the motor 12 of the post driver 10, which causes the hammer 28 to repetitively strike the anvil 30, thereby transmitting impact loads from the anvil to the post 46. Preferably, the collet opening formed by the guide collet members 36 is closely matched to the diameter of the post 46, but such that the post can freely slide through the collet opening. Closely matching the diameters ensures that the end of the post 46 will be centered relative to the anvil 30, thereby minimizing any torque acting on the anvil during impact.

Figure 5:
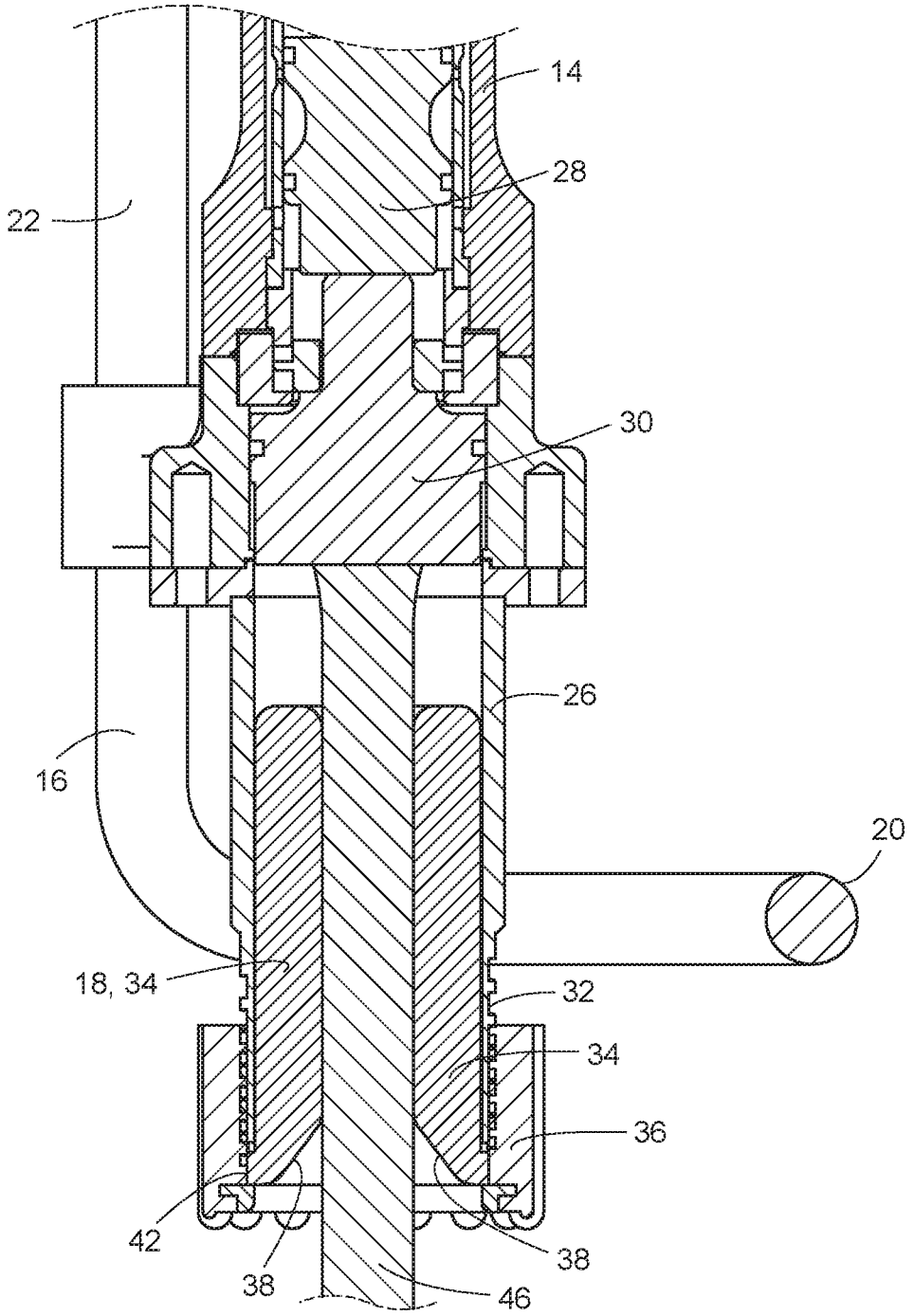
FIG. 5 is identical to FIG. 3 except that FIG. 4 depicts the end of the post being mushroomed.
Figure 6:
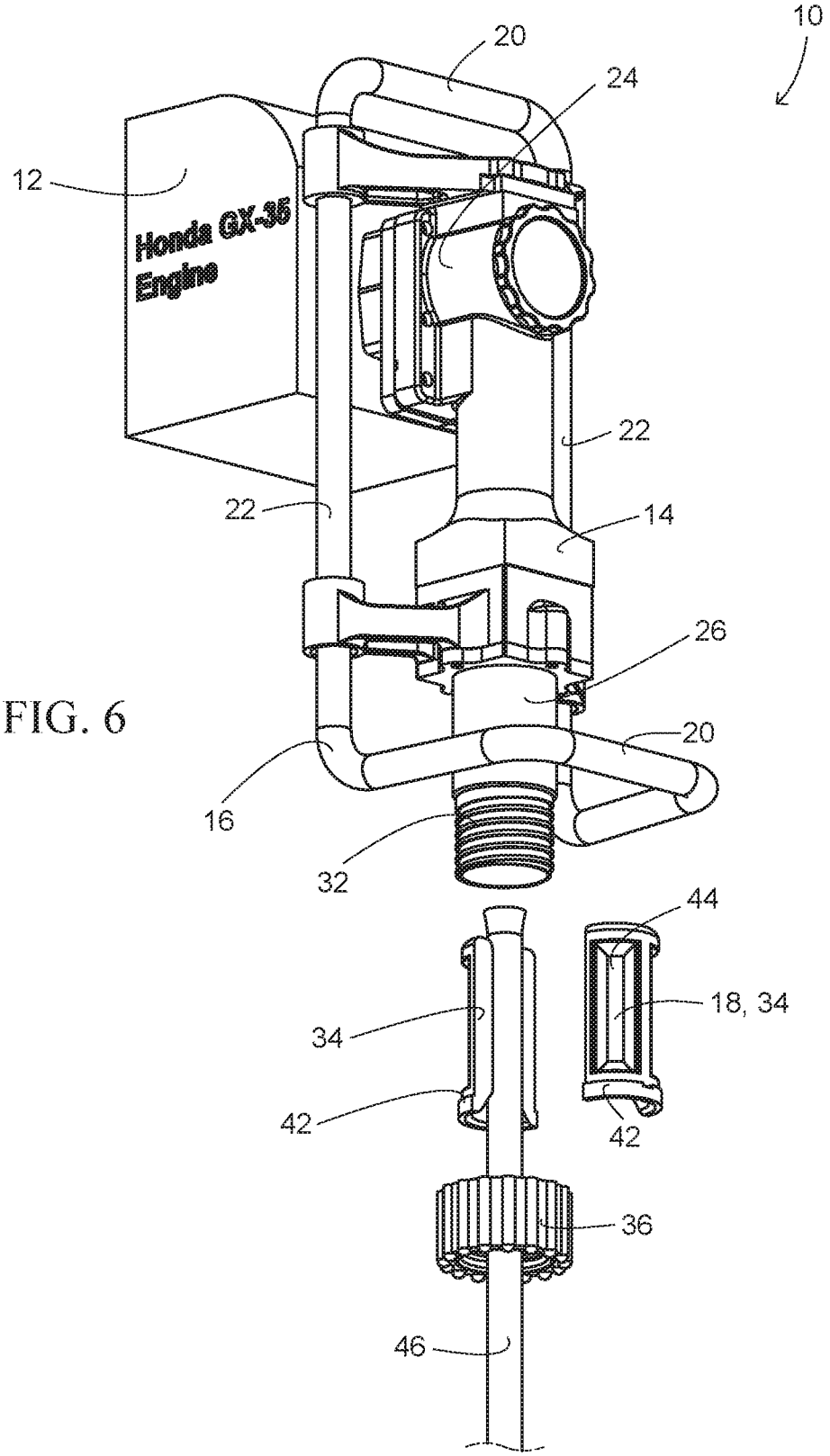
FIG. 6 is a perspective view of the post driver with the collet assembly disassembled for the removal of the mushroomed post.

After the post 46 has been driven to its desired depth, the post driver 10 usually can be slid off of the end of the post. However, as depicted in FIG. 5, the end of the post 46 may in some cases become mushroomed due to the impacts it has received. If the guide collet was a single piece having a cylindrical opening, the guide collet would then become stuck onto the post 46 since the end of the post would have a larger diameter than the collet opening (assuming the diameter of the collet opening closely matches the diameter of the remainder of the post, which is preferred). With the collet assembly 18 of the present invention, this is not a problem. If mushrooming occurs to such an extent that the end of the post no longer can pass through the opening formed by the semicylindrical channels 40 of the guide collet members 34, the attachment member 36 can be released from the tube portion 26 of the post driver 10, and the collet members can then slide completely out of the tube portion. As shown in FIG. 6, the guide collet members 34 can then be separated to release the collet members from the post 46 within passing the mushroomed end of the post through the collet opening. Although the mushroomed end of the post still must be passed through the central opening of the attachment member 36 of the collet assembly 18, this is not a problem since the central opening of the attachment member is much larger than the post diameter. After separating the post from the post driver 10, the guide collet members 34 can then be reattached to the post driver via the attachment member 36.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. A method of driving a post comprising:

inserting a post partially into a post driver, the post driver comprising a main body having a cavity and guide collet attached to an end of the main body, the guide collet comprising a plurality of parts that collectively form a post opening, the insertion including passing an end of the post through the post opening of the guide collet with the plurality of parts of the guide collet assembled to form the guide collet with the post opening and into the cavity in a manner such that post extends through the post opening;

removing the post from the post driver by detaching the guide collet from the main body and separating the parts of the guide collet such that the removal of the post occurs without passing the end of the post through the opening of the guide collet.

2. A method in accordance with claim 1 wherein the guide collet consists of only two parts.

3. A method in accordance with claim 1 further comprising removing an attachment member from the main body to allow the guide collet to be detached from the main body.

4. A method in accordance with claim 3 wherein the attachment member comprises an opening and inserting the post partially into a post driver comprises passing the end of the post through the opening of the attachment member.

* * * * *